United States Patent [19]

Pavely

[11] Patent Number: 4,712,707

[45] Date of Patent: Dec. 15, 1987

[54] CLOSURE FOR A CONTAINER

[75] Inventor: Andrew P. Pavely, Blunsdon, United Kingdom

[73] Assignee: Metal Box p.l.c., Reading, England

[21] Appl. No.: 905,185

[22] Filed: Sep. 9, 1986

[30] Foreign Application Priority Data

Sep. 9, 1985 [GB] United Kingdom ..... 8522284

[51] Int. Cl.[4] ..... B65D 39/00

[52] U.S. Cl. ..... 220/307; 220/234

[58] Field of Search ..... 220/307, 233, 234, 237, 220/238; 215/355

[56] References Cited

U.S. PATENT DOCUMENTS 3,279,643 10/1966 Amesbury et al. ..... 220/234
4,231,486 11/1980 Bock ..... 220/307

FOREIGN PATENT DOCUMENTS 717687 7/1968 Belgium .
1536092 3/1970 Fed. Rep. of Germany .
2146267 4/1973 Fed. Rep. of Germany .
2715390 10/1978 Fed. Rep. of Germany .
1194211 11/1959 France .
6509615 1/1967 Netherlands .
338108 4/1959 Switzerland .

*Primary Examiner*—George T. Hall
*Attorney, Agent, or Firm*—Burns, Doane, Swecker & Mathis

[57] ABSTRACT

A closure for a container such as a can for carbonated beverages comprises a collar which is an easy fit in the opening in the container and a plug which is hingedly connected to the collar and when fitted into the collar causes the collar to be elastically deformed into tight sealing engagement with the opening and with the plug.

15 Claims, 21 Drawing Figures

CLOSURE FOR A CONTAINER

BACKGROUND OF THE INVENTION

1. Field of the Invention

The invention relates to a closure for a container and in particular relates to a resealable closure suitable for use in an end of a cylindrical can for carbonated beverages.

2. Brief Description of the Prior Art

Prior closures are known which comprise a collar which is fitted into an opening in a container and a plug which then fits into and closes the collar. In these prior closures the collar is dimensioned to provide a permanent sealing fit within the opening and the plug is dimensioned to provide a tight sealing fit within the collar. Containers employing such closures can be resealed after opening by replacing the plug in the collar. There is, therefore, a primary or permanent seal between the collar and the container and a secondary or re-usable seal between the plug and the collar.

SUMMARY

According to the invention there is provided a closure for a container having an opening therein which includes a flared closure-engaging surface, the closure comprising an annular collar adapted to enter the opening and a plug hingedly connected to the collar, wherein the collar is relatively elastic and is an easy fit in the opening in a relaxed state, and the plug is relatively stiff so that when the plug is inserted into the collar it closes the opening and causes the collar to be elastically deformed into tight sealing engagement with the flared surface of the opening and with the plug.

The primary seal is thus effected at the same time as the secondary seal by insertion of the plug into the collar. This permits a simple and reliable attachment of the closure to the container, which is compatible with conventional can filling and seaming equipment.

According to one preferred feature of the invention the collar comprises a substantially cylindrical neck located in the opening, a radial flange connected to the neck of the collar at its end outside the container, and a thickened portion connected to the neck of the collar at its end within the container which in the relaxed condition flares both inwardly and outwardly from the neck of the collar.

The thickened portion is pushed outwardly by insertion of the plug and is then squeezed between the plug and the opening to form a seal.

According to another preferred feature the collar is provided with an annular groove and the plug is provided with an annular bead adapted to snap fit into the annular groove when the plug is inserted into the collar.

In a yet further preferred featured the collar is provided with a substantially axial venting groove extending from the end of the neck of the collar outside the container to a point slightly spaced from the annular groove.

There is also provided a container having an opening therein receiving a closure according to the invention, wherein the opening includes a frusto-conical surface for sealing engagement with the collar; said surface flaring outwardly into the container.

DETAILED DESCRIPTION OF THE INVENTION

Figure 1:
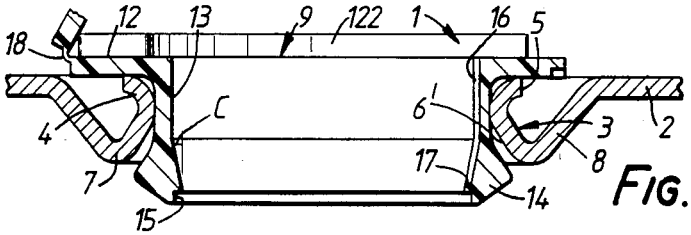
FIG. 1 is a sectional view through a closure in a container opening, in an open condition.
Figure 2:
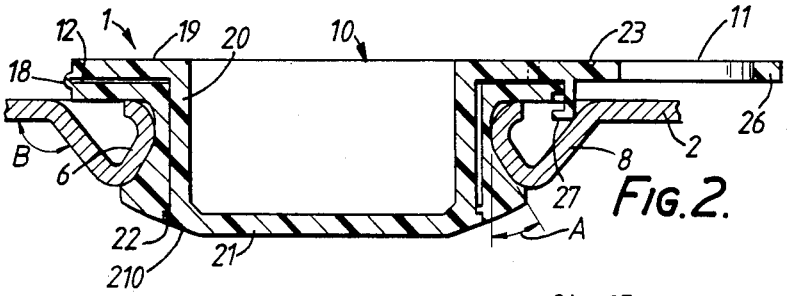
FIG. 2 is a sectional view through a closure in a container opening, in a closed condition.
Figure 3:
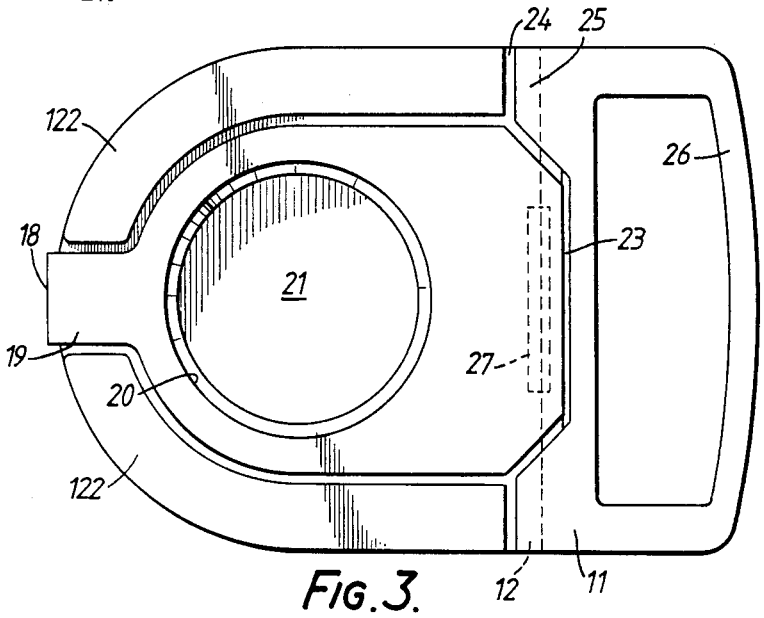
FIG. 3 is a plan view of a closure in a closed condition.

With reference to the drawings, a closure 1 is shown fitted into a circular opening formed in the end 2 of a metal container or can (not shown). The opening is defined by an annular wall 3 which is formed on the can end by punching or otherwise cutting out a hole in the can end and forming the surrounding material.

The wall 3 comprises an upper portion 4 which is curved in section and terminates in a substantially vertical end face 5 and a sealing portion 6 which adjoins the upper portion at the narrowest point of the opening and flares outwardly into the can at an angle A to the axis of the closure. The radially inner surface of the wall portion 6 provides a frusto-conical surface 6' for sealing engagement with the collar. The angle A is preferably in the range of 5° to 45° and is more preferably in the range of 10° to 20°. The sealing portion of the wall 3 is connected to the rest of the can end by a lower curved portion 7 and an annular ramp 8 which is inclined to the can end at an angle B. The angle B is preferably in the range of 130° to 150° and more preferably is about 135°.

The closure 1, which is retained in the opening, comprises three main parts: a collar 9, a plug 10, and a pull tab 11. As best shown in FIG. 1, the collar can be pushed into the opening to form an easy fit within the annular wall 3. The collar comprises a radial range 12 supporting a pair of ribs 122, a substantially cylindrical neck 13, and a thickened portion 14 which, in the relaxed condition shown in FIG. 1, flares both inwardly and outwardly from the bottom of the neck 13. As shown in FIG. 1 the portion 14 flares inwardly at an angle C to the axis of the closure. The angle C is preferably about 10°. The portion 14 is provided with an annular locking groove 15 and a substantially axial venting groove 16. The groove 16 does not extend the full axial length of the collar, but terminates at a point 17 spaced slightly from the locking groove 15.

The plug may be attached to the collar such as by a hinge 18, or by a snap fit ring or plug (not shown) which engages a corresponding formation on the collar, or may be separate therefrom. The plug comprises a radial flange 19, a cylindrical neck 20, and a bottom wall 21. When the plug is inserted into the collar 9, the flange 19 overlies the flange 12 and is substantially surrounded by the ribs 122, the neck 20 is tightly received within the neck 13, and an annular rib 22, formed at the juction between the neck 20 the bottom wall 21, snaps into the locking groove 15. The materials, configuration, and dimensions of the plug and collar are selected such that the plug urges the collar against the wall 3 formed in the can end. In particular, the lower part of the neck 13 and the thickened portion 14 are elastically deformed into sealing engagement with the portions 6 and 7 of the wall 3 and with the plug 9. A hydrostatic pressure such as obtains in a can of carbonated beverage to act on the bottom wall 21 of the plug 9 is delivered to the peripheral junction of cylindrical neck 20 and bottom wall 21 where the locking groove 15 of collar 9 engages with the annular rib 22 so that a compressive load is imposed on the collar material to press it more tightly onto the frusto-conical surface 6' of the sealing portion 6 which acts as a buttress. It will be noticed that there is a continuum of material from the periphery wall 21 to the sealing portion 6.

If the bottom wall is convex into the container any hydrostatic pressure within the container will tend to flatten the convexity so imposing a desirable degree of lateral spread to compress the collar. However, such a modified convex wall must be stiff enough to prevent any risk of reversal to a concave shape which would relieve the lateral spreading pressure. By these means it is possible to have a collar which requires minimal effort to fit but which permits considerably increased interference when the plug is inserted. The collar and plug may be made of any suitable material such as polypropylene or nylon if the closure is intended for use in a pressurised beer or beverage can. For products exerting little or no internal pressure, polyethylene may be used. The collar is made of relatively elastic material such that it will form a good seal with the can end and with the plug when the relatively stiff plug is inserted. The plug may be provided with stiffening ribs (not shown) or stiffened by the provision of a secondary plug (not shown) which is integral with the pull tab and can be fitted inside the neck 20 of the plug. Preferably the collar, plug, and pull tab are integrally moulded of the same material and in this case the relative stiffness of the plug is provided entirely by the configuration of the plug.

Figure 4:
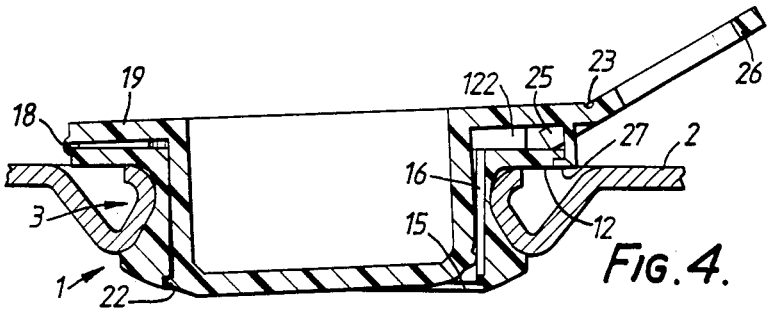
FIG. 4 is a sectional view through a closure in a container, in a partially open condition.
Figure 5:
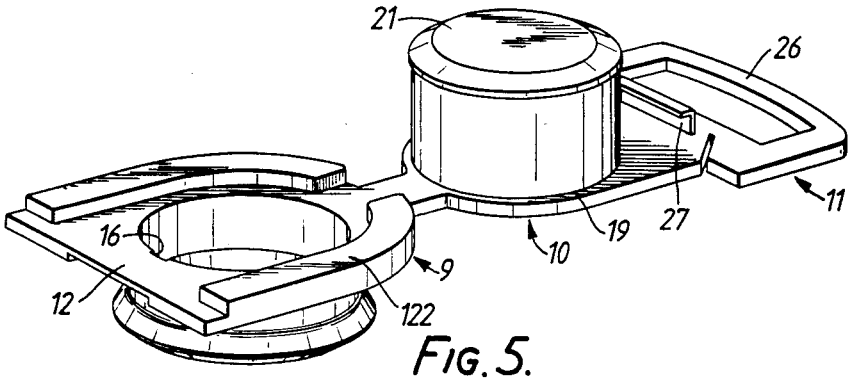
FIG. 5 is a perspective view of the closure of FIGS. 1–4.

The pull tab 11 is integrally moulded with the plug and is connected thereto by a flexible hinge 23. The pull tab lies in the same plane as the flange 19 and effectively forms an extension thereof. Dog-legged slots 24 separate the flange 19 from the pull tab and define legs 25 on the pull tab. When the lift ring 26 of the pull tab is raised, the pull tab is pivoted about the hinge 23 and the legs 25 press on the underlying flange 12 and help to lever the plug out of the collar. A latch 27 depending from the pull tab catches on the edge of flange 12 after initial opening of the closure as shown in FIG. 4. In this position, the bead 22 has been levered out of the groove 15 over approximately half its circumferential extent and the inside of the can is vented to the outside through the venting groove 16. Prior to venting, any internal pressure in the can acts to assist the seal between the plug and the collar and between the collar and the can end if the bottom of the plug is slightly convex. The convexity of the bottom of the plug may be provided by the bottom wall being part spherical or, as shown, may be provided by an annular chamferred portion 210 of the bottom 21. When the initial opening and venting has taken place, the forces retaining the plug within the collar are greatly reduced and the plug can then be removed by pivotal movement about the hinge 18. The action of the latch 27 momentarily interrupts the opening procedure such that complete venting can take place before the plug is fully removed from the collar.

When used in a can end of a carbonated drinks can, the opening may be provided off-centre such that the venting groove 16 is central to the can. In the embodiment shown, the left hand side of the closure will be near to the edge of the can to permit drinking through the collar. The relatively loose fit of the collar in the can end enables the closure to be rotated after opening so that the plug and pull tab do not get in the way of a drinker.

Instead of forming an extension to the plug flange 19 in the same plane thereof the pull tab may be constructed to overlie the plug and be fitted thereto by a snap or plug fit. In this case, levering legs may be arranged to act on the can end when the pull tab is hingedly lifted off the plug.

Figure 6:
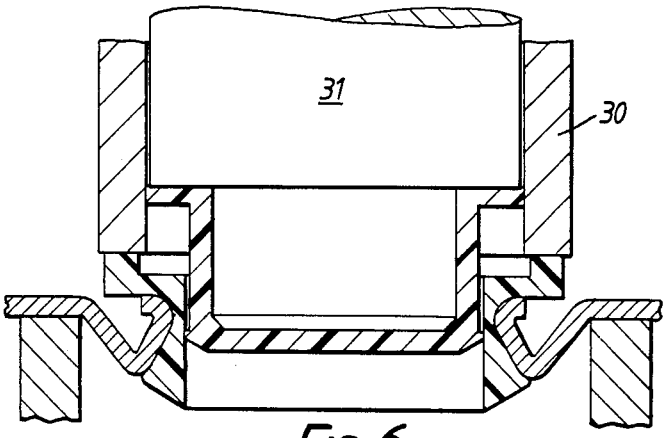
FIG. 6 is a diagrammatic view of a closure of FIGS. 1–5 being fitted to a can end.

Assembly of the closure in a can end is shown diagrammatically in FIG. 6. A press tool having a sleeve 30 and a punch 31 slidable therein is used first to snap fit the collar into the can end and hold it flat by means of the sleeve, and then to push the plug into the collar by means of the punch.

Some alternative embodiments to that shown in FIGS. 1–6 are shown in FIGS. 7–21. Each of these alternative eabodiments retains the essential features of the invention and in particular, each closure comprises a relatively elastic annular collar 9 and a relatively stiff plug 10 which when inserted into the collar causes the collar to be elastically deformed into tight sealing engagement with the opening of the container and with the plug.

Figure 7:
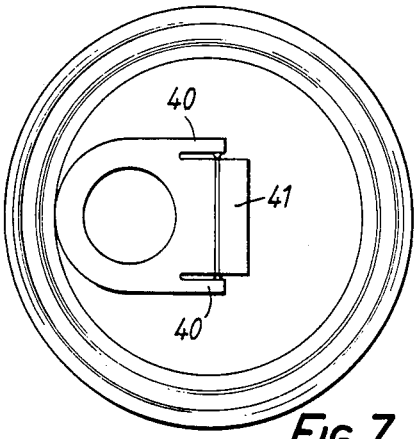
FIGS. 7 and 8, FIGS. 9 and 10, FIGS. 11 and 12, FIGS. 13 and 14, FIGS. 15 and 16, FIGS. 17, 18 and 19, and FIG. 20 show alternative embodiments and modifications of a closure.
Figure 8:
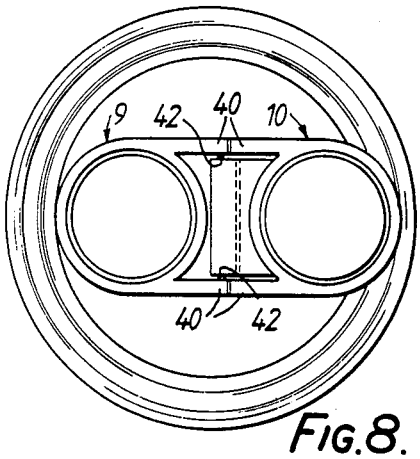

FIGS. 7 and 8 show a closure wherein the plug 9 and collar 10 are hingedly connected by tangential limbs 40 and a lift flap 41 is hingedly connected to the plug. After the plug has been pulled out of the collar, the plug may be held flat against the can end as shown in FIG. 8. Tamper indicating filaments may be connected between the flap 41 and the liabs 40 when the closure is formed. The filaments are broken when the closure is opened.

Figure 9:
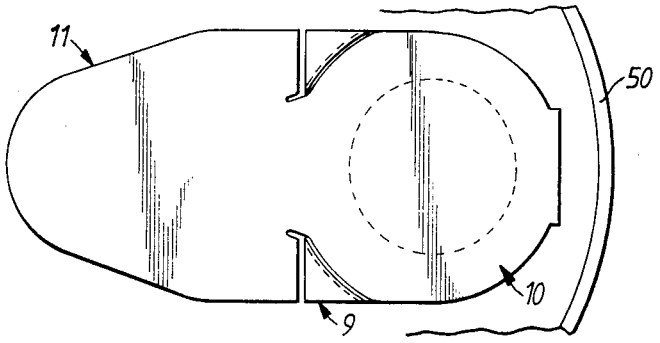
Figure 10:
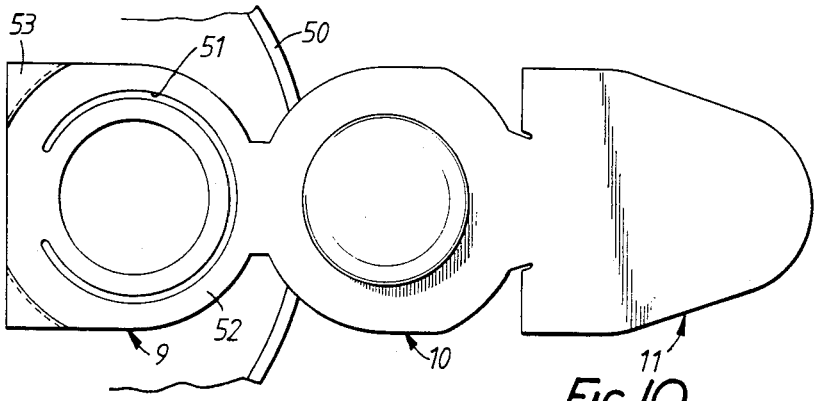

In the embodiment shown in FIGS. 9 and 10, the rim of the can is shown at 50 and the flange of the collar 9 is divided by an incomplete circular slot 51. When the plug 10 has been removed from the collar, as shown in FIG. 10, the pull tab, plug, and the outer part 52 of the collar can be pulled away from the edge of the can to permit pouring or drinking through the collar. When the plug is fully inserted into the collar, the plug flange is overlain with slight clearance by a pair of vent control latches 53. The plug is momentarily held up by the latches as it is removed from the collar.

Figure 11:
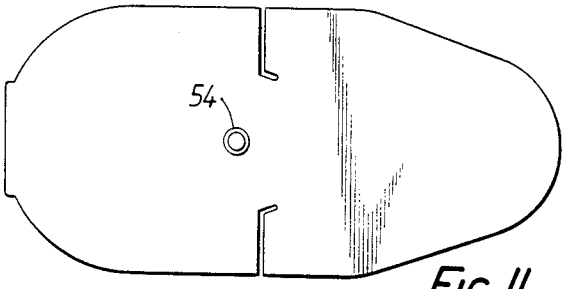
Figure 12:
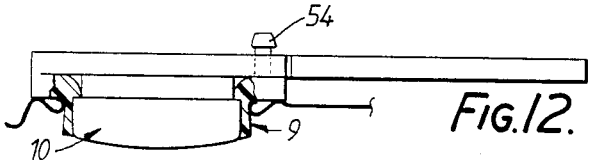

In FIGS. 11 and 12 an embodiment similar to that of FIGS. 9 and 10 is provided with a latch peg 54 which stands on the flange of the collar 9, and passes through a slightly undersized aperture in the flange of the plug 10. The latch peg thus momentarily interrupts removal of the plug and ensures that venting is achieved before the plug is fully removed.

Figure 13:
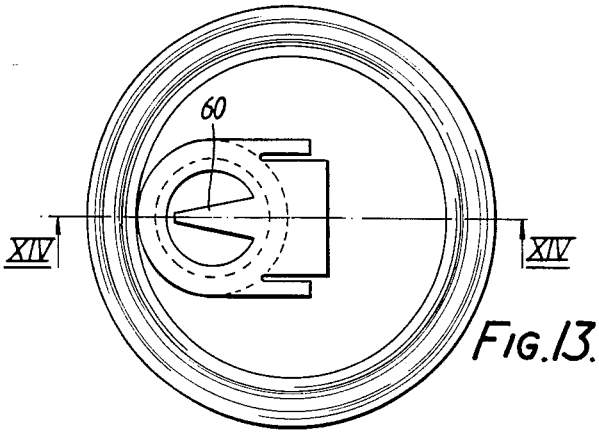
Figure 14:
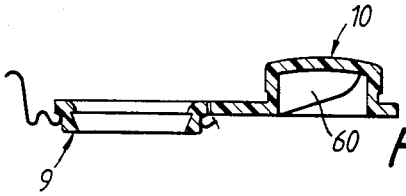

The embodiment of FIGS. 13 and 14 is similar to that of FIGS. 8 and 9 except that a rib 60 is provided in the plug 10 to add strength to the plug and to provide a lever for lifting the plug from the collar 9.

Figure 15:
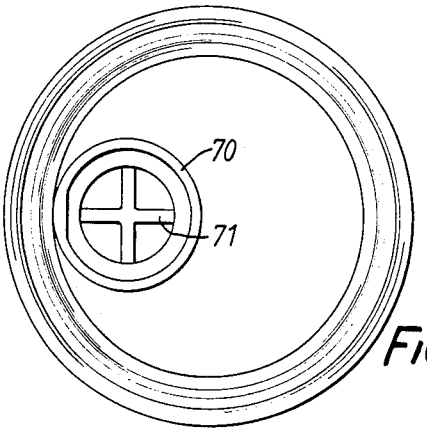
Figure 16:
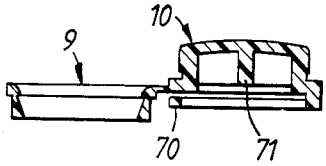

In the embodiment of FIGS. 15 and 16, the pull tab is provided by a ring 70 attached to the plug. The plug 10 is also strengthened by a cruciform rib 71.

Figure 17:
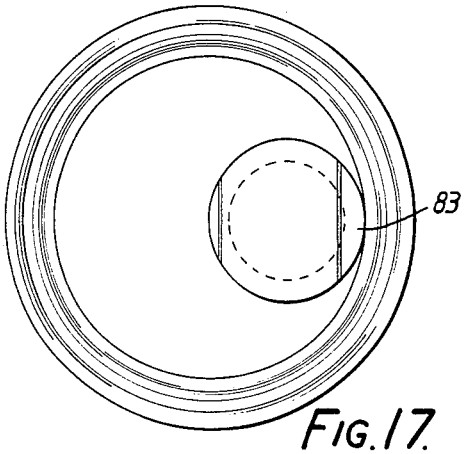
Figure 18:
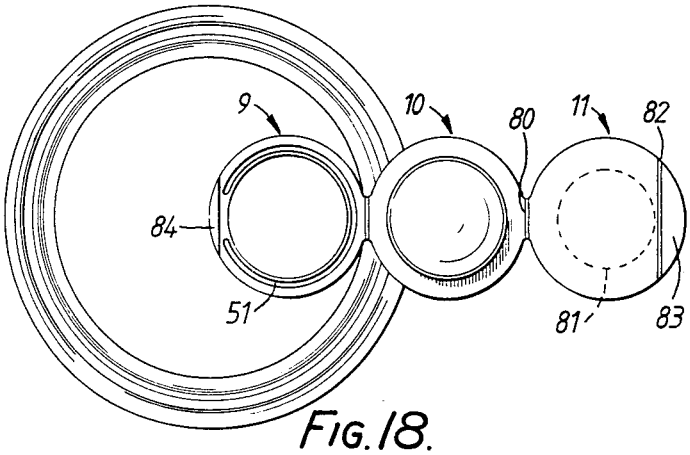
Figure 19:
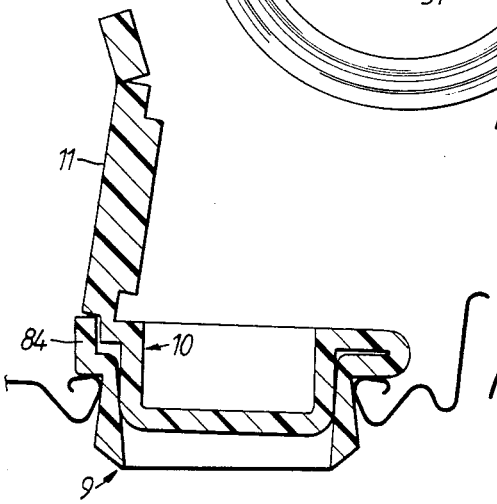

The embodiment of FIGS. 17, 18 and 19 is similar to that of FIGS. 9 and 10 except that the pull tab 11 is connected to the plug 10 by a hinge 80 so as to fold back over the plug, in which position a plugging portion 81 on the pull tab is a fairly loose push fit into the top of the plug. A hinge 82 allows a segment 83 of the pull tab to be raised from the folded portion shown in FIG. 17 so that the pull tab can be lifted off the plug. A small upstanding wall 84 on the flange of the collar 9 provides a pivot point for the edge of the pull tab to assist in removal of the plug.

Figure 20:
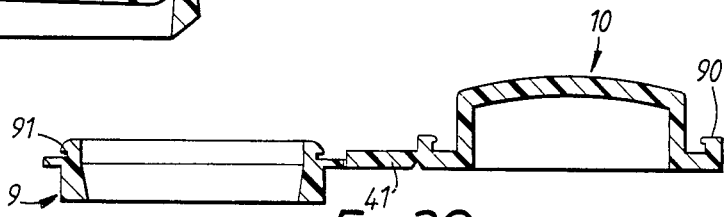

FIG. 20 shows a version of a closure similar to that of FIGS. 7 and 8 wherein the plug 10 forms an overcap for the collar 9 and is held thereon by engagement of an annular rib 90 on the plug in an annular groove 91 on the collar.

In the embodiments described in relation to FIGS. 1–20, the raw end face 5 of the opening curl is shown as being outside the container but the opening could be constructed with this edge inside the container if non-aggressive products are to be packed.

Figure 21:
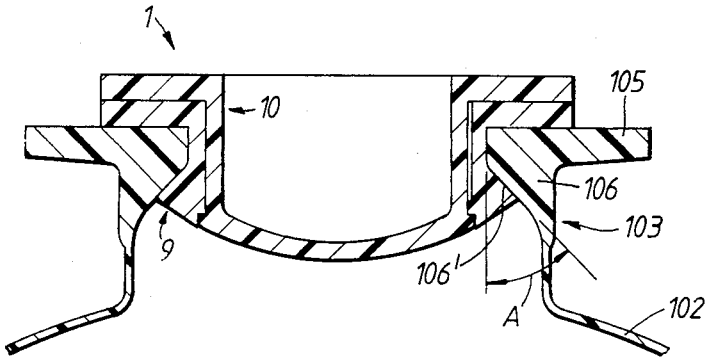
FIG. 21 shows a bottle having a neck receiving a closure according to the invention.

FIG. 21 shows a closure 1 comprising a collar 9 and a plug 10 fitted into the neck 103 of a bottle 102. The neck includes a thickened portion 106 which has a frusto-conical surface 106' for sealing engagement with the collar, and a radial flange 105. The frusto-conical surface ares outwardly into the neck of the bottle at an angle A which is preferably in the range of 5° to 45° and is more preferably in the range of 10° to 20°. The bottle is blow moulded from plastics material. This construction has a significant advantage over conventional screw top bottles in that a considerable saving in plastics material is achieved by avoiding the need for screw threads on the neck of the bottle and cap.

I claim:

1. A closure for a container having an opening therein which includes a frusto-conical closure-engaging surface which flares outwardly into the container, the closure comprising:

a relatively elastic annular collar which is an easy fit in the opening in the relaxed state and consists of a substantially cylindrical neck located in the opening, a radial flange connected to the neck of the collar at its end outside the container, and a thickened portion connected to the neck of the collar at its end within the container and which in the relaxed state flares both inwardly and outwardly from the neck of the collar;

and a relatively stiff plug hingedly connected to the collar which is inserted into the collar to close the opening and engages the thickened portion of the collar and causes it to be elastically deformed into tight sealing engagement with the frusto-conical closure engaging surface of the opening and with the plug.

2. A closure as claimed in claim 1, wherein the collar is provided with an annular groove and the plug is provided with an annular bead adapted to snap fit into the annular groove when the plug is inserted into the collar.

3. A closure as claimed in claim 2, wherein the collar is provided with a substantially axial venting groove extending from the end of the neck of the collar outside the container to a point slightly spaced from the annular groove.

4. A closure as claimed in claim 1, wherein the plug comprises a cylindrical neck adapted to be fitted within the collar and an end wall closing the neck of the plug at its end within the container.

5. A closure as claimed in claim 4, wherein the plug comprises a radial flange adapted to overlie the flange of the collar when the plug is inserted into the collar.

6. A closure as claimed in claim 1, further comprising a pull tab hingedly connected to the plug.

7. A closure as claimed in claim 6, wherein the pull tab is provided with a depending latch which is adapted to catch on the flange of the collar when the plug is initially lifted out of the collar.

8. A closure as claimed in claim 1, wherein the plug is provided with one or more stiffening ribs.

9. A closure as claimed in claim 1, wherein the plug forms an overcap for the collar and is held thereon by engagement of an annular rib on the plug in an annular groove on the collar.

10. A container having an opening therein receiving a closure as claimed in claim 1, wherein the opening includes a frusto-conical surface for sealing engagement with the collar; said surface flaring outwardly into the container.

11. A container as claimed in claim 10 wherein the frusto-conical surface is inclined to the axis of the closure at an angle in the range of 5° to 45°.

12. A container as claimed in claim 11 wherein the frusto-conical surface is inclined to the axis of the closure at an angle in the range of 10° to 20°.

13. A container as claimed in claim 10 wherein the container is a cylindrical can and wherein the frusto-conical surface is provided on the radially inner surface of an annular wall formed from material surrounding a hole cut out of an end of the can.

14. A container as claimed in claim 13 wherein the annular wall is supported by an annular ramp inclined to the can end.

15. A container as claimed in claim 10 wherein the container is a bottle and wherein the frusto-conical surface is provided on the radially inner surface of an annular wall forming the neck of the bottle.

* * * * *